United States Patent [19]

Hsu

[11] 3,937,349

[45] Feb. 10, 1976

[54] SELF-OPENING CROWN CAP

[76] Inventor: Shih Chen Hsu, No. 34, Tien Suei Road, Taipei, China/Taiwan

[22] Filed: Sept. 11, 1974

[21] Appl. No.: 504,920

[52] U.S. Cl. ..... 215/254
[51] Int. Cl.[2] ..... B65D 41/32
[58] Field of Search ..... 215/254, 305

[56] References Cited

UNITED STATES PATENTS

| | | | |
|---|---|---|---|
| 2,741,388 | 4/1956 | Rubin | 215/254 |
| 3,258,149 | 6/1966 | Wheaton | 215/254 |
| 3,301,426 | 1/1967 | Kanalus | 215/254 |
| 3,382,997 | 5/1968 | Tsuji | 215/253 |
| 3,397,661 | 8/1968 | Allman | 215/254 |
| 3,447,710 | 6/1969 | Blair | 215/254 |
| 3,785,519 | 1/1974 | Huh | 215/254 |

*Primary Examiner*—William Price
*Assistant Examiner*—Ro E. Hart
*Attorney, Agent, or Firm*—Shoemaker and Mattare, Ltd.

[57] ABSTRACT

This invention relates to a crown cap, and particularly, to an easy open type crown cap provided with an inclined tongue element and two non-intersecting score lines extending from two sides of said tongue element toward the internal side of the crown cap and being easily removed therefrom by hand without the need of using any auxiliary openers.

6 Claims, 11 Drawing Figures

SELF-OPENING CROWN CAP

BACKGROUND OF THE INVENTION

The prior art crown caps generally require an auxiliary tool for removing the caps therefore, rendering it very inconvenient to the user especially at picnics or in the woods where a bottle opener is not readily available. In view of this, there were designs of easy open means for crown cap of a bottle, such as U.S. Pat. Nos. 3,200,982; 3,382,997 and 2,778,520 etc. With respect to the structure, although all those designs have score lines and tongue element, yet, owing to their improper position on the cap, which is against the direction of the applied force, hence during opening, a considerable force is still required. Particularly, if the liquid in the bottle contains carbon dioxide pressure, it would be difficult to effect both perfect tight seal and easily opened closure.

SUMMARY OF THE INVENTION

The primary object of this invention is to provide a crown cap which can be removed by bare hand and without the use of any auxiliary openers.

Another object of the invention is to provide a crown cap which can be closely and tightly clamped no matter whether the liquid filled-in is pressurized or not, and which can be opened by bare hand with slight operating force.

A further object of this invention is to provide a crown cap which is inexpensive in construction, which may be used without changing present bottle-capping equipment, and which may be used in present bottle dispensing machines without modification thereof.

Other features and advantages of the invention will be more apparent from the following description taken in connection with the accompanying drawings wherein:

Figure 1:
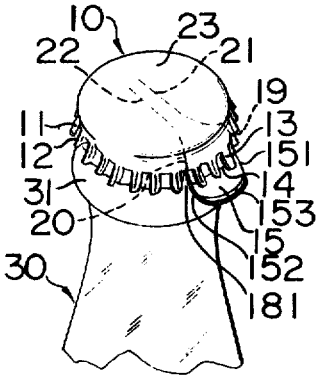
FIG. 1 is a perspective view of the first embodiment of the invention.
Figure 7B:
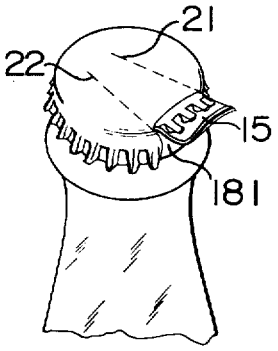
FIG. 6 to FIG. 9 are perspective views showing various stages of removal from the bottle wherein the hand carriage at second stage in FIG. 7B is not shown.
Figure 2:
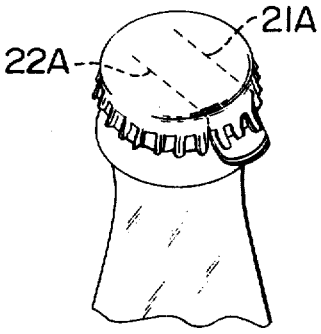
FIG. 2 is a perspective view of the second embodiment of the invention.
Figure 3:
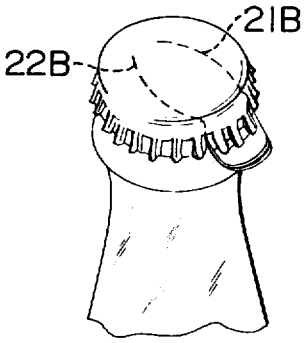
FIG. 3 is a perspective view of the third embodiment of the invention.
Figure 4A:
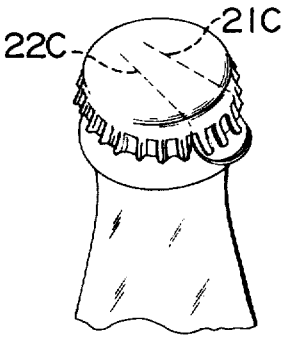
FIG. 4A is a perspective view of the fourth embodiment of the invention.
Figure 4B:
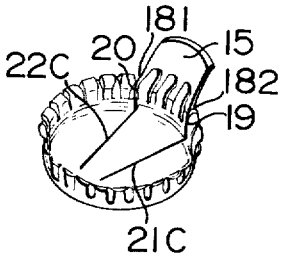
FIG. 4B is a bottom view of the fourth embodiment.

In the first embodiment of the present invention as shown in FIG. 1, a crown cap 10 is placed on the annular head 31 of a bottle 30. The cap 10 has a plurality of raised portions 11 and depressed portions 12 to clamp onto the bottle; a tongue element 15 inclined downward is extended between a continuity of two to three raised portions with an incline angle of 30° to 45°, and the two sides 151, 152 of said tongue element 15 also downward along the radian of the raised portions with a notch 181, 182 (shown in FIG. 4B) provided between the two sides of said tongue element 15 and the adjacent portions of said raised portions respectively. With these two notches 181, 182 as starting points, two score lines 19, 20 of proper depth are formed separately at the internal side of the crown 10 along the direction of applying force for pulling said tongue element 15 upward. On the same principle, two score lines 21, 22 continued with score lines 19, 20 are formed at the flat top 23 of said crown cap 10 along the directions of notches, in which, score line 19 meets score line 21, and score line 20 meets score line 22, while the score lines 21, 22 on the flat top 23 must exceed the center of said cap 10 and both do not intersect each other. Furthermore, the lowest edge of tongue element 15 is formed a lip edge 153 slightly warped upward.

Although the crown cap according to the present invention is provided with a tongue element 15 and notches 181, 182 at two sides of the tongue, yet its circumferential raised portions 11, 13 and depressed portions have the same characteristics as conventional crown caps, and therefore it can closely and tightly seal the bottle. Moreover, the cap of this invention may be used without changing bottle-capping equipment, and which may be used in present bottle dispensing machines without modification thereof.

Figure 5:
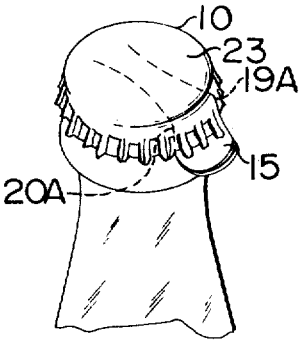
FIG. 5 is a perspective view of the fifth embodiment.
Figure 7A:
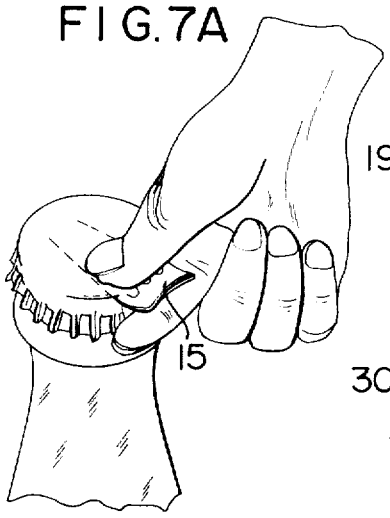

FIGS. 2 to 4A are other embodiments of the present invention, except the slightly different patterns of 21A, 21B, 21C and 22A, 22B, 22C; other constructions are the same. FIG. 4B is a bottom view of the cap, showing its two score lines 19-21C, 20-22C formed in proper depth at the internal side of said cap. FIG. 5 is another embodiment which differs from previous ones in that no notches are formed at two sides of the tongue element 15 and that the two score lines 19A, 20A are extended continuously from the flat top 23 of the cap 10 to the two sides of tongue element 15.

Figure 6:
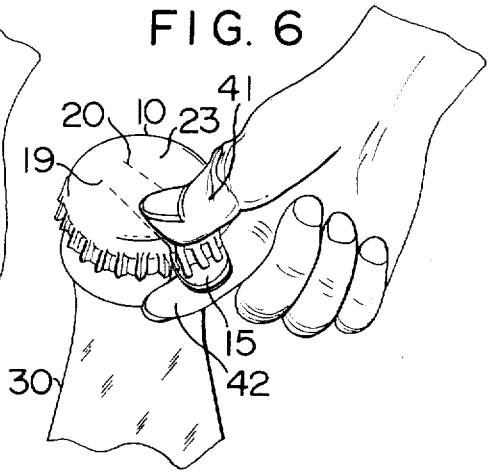
Figure 9:
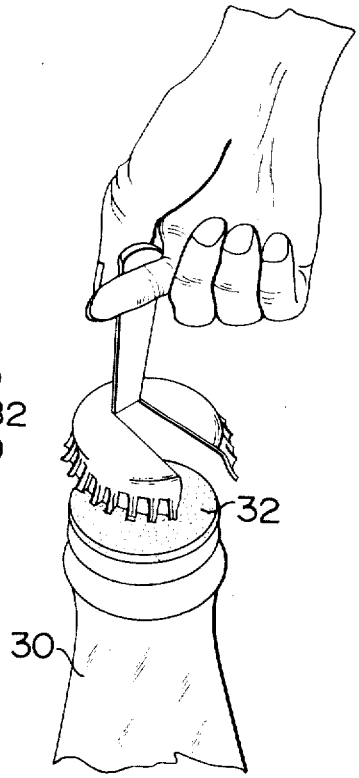
Figure 8:
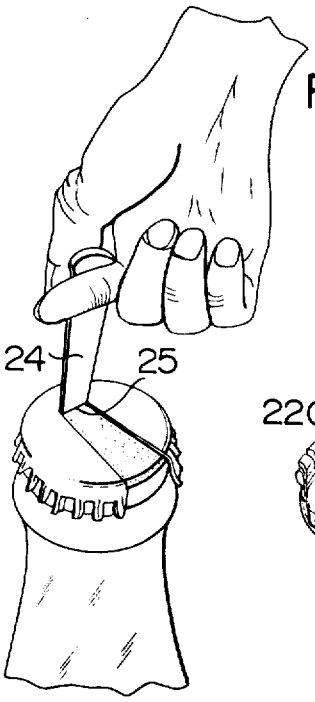

The operation of the present invention is shown in FIGS. 6 to 9. In FIG. 6, hold the bottle body by the left hand (not shown), press the thumb 41 on the flat top 23 of the cap 10, place the forefinger 42 underneath the tongue element 15, pull the tongue element 15 upward with a slight force, then, owing to notches 181, 182 and score lines 19, 20 at the two sides of tongue element (or the score lines 19A, 20A provided along the direction of the applying force as shown in FIG. 5) the tongue element 15 can be lifted, and the balanced clamping can be partly disrupted as shown in FIGS. 7A and 7B. At the same time, the crown 10 has still a part of the clamping force, therefore, the tongue element 15 is pulled upward again and it would stand up along score lines 21, 22 together with the solid piece 24 between the two score lines; as the ends of said score lines 21, 22 do not intersect each other, there is still a solid portion 25 between the two ends of the two score lines 21, 22 as shown by FIG. 8. Now, the clamping force of cap 10 is completely disrupted, the tongue element 15 is lifted along with the cap 10 which is removed from the bottle 30 without the need of using any auxiliary openers. As shown in FIG. 9, wherein a yieldable fluid-tight gasket 32 is still provided as conventional crown cap.

It can be readily seen from the foregoing description, the most important feature of the present invention is that the two notches provided at two sides of the tongue element and the two score lines extending along the direction of applying force from said notches to the cap top and exceeding the center of said cap by some distance with ends never intersected, thus, the original clamping characteristics of the crown cap is not disrupted, while the crown can be opened lightly and easily by bare hand and removed from the bottle without the need of using any openers.

I claim:

1. An easy-opening crown cap for closing the open end of bottles and the like, wherein the crown cap is of the type having a substantially flat top and a depending annular skirt of crimped configuration having alternate raised and depressed portions, a downwardly and outwardly inclined tongue on the cap projecting below a bottom edge portion of the skirt, said tongue having a plurality of longitudinally extending reinforcing ribs of a length slightly greater than the crimps in the skirt, and a lower end edge portion of the tongue being warped to reinforce the tongue, said cap having a pair of circumferentially spaced apart notches extending upwardly from a lower edge of the skirt in registry with opposite edges of the tongue, and a pair of weakened score lines extending upwardly from the notches across the skirt and across the flat top of the cap a distance greater than the radius of the cap but less than the diameter thereof, whereby the tongue may be grasped by hand and lifted to fracture the score lines and remove the cap from the bottle and the like.

2. A cap as in claim 1, wherein the score lines converge into close proximity with one another and then extend parallel to one another over the major portion of the width of the cap.

3. A cap as in claim 1, wherein the score lines converge toward one another in substantially straight lines.

4. A cap as in claim 1, wherein the score lines are parallel to one another substantially throughout their length.

5. A cap as in claim 1, wherein the score lines are arcuate and are convergent adjacent their midportions and divergent at their opposite ends.

6. A cap as in claim 1, wherein the score lines are arcuate and are convergent at their opposite ends and divergent at their midportions.

* * * * *